US011369182B2

(12) United States Patent
Schreiber

(10) Patent No.: US 11,369,182 B2
(45) Date of Patent: Jun. 28, 2022

(54) APPLICATOR FOR APPLYING A COSMETIC PRODUCT TO KERATINOUS MATERIALS

(71) Applicant: L'OREAL, Paris (FR)

(72) Inventor: Camille Schreiber, Clichy (FR)

(73) Assignee: L'OREAL, Paris (FR)

( * ) Notice: Subject to any disclaimer, the term of this patent is extended or adjusted under 35 U.S.C. 154(b) by 0 days.

(21) Appl. No.: 16/645,662

(22) PCT Filed: Oct. 9, 2018

(86) PCT No.: PCT/EP2018/077384
§ 371 (c)(1),
(2) Date: Mar. 9, 2020

(87) PCT Pub. No.: WO2019/072788
PCT Pub. Date: Apr. 18, 2019

(65) Prior Publication Data

US 2020/0275760 A1 Sep. 3, 2020

(30) Foreign Application Priority Data

Oct. 12, 2017 (FR) ..... 17 59552

(51) Int. Cl.
*A46B 11/00* (2006.01)
*A45D 40/26* (2006.01)
(Continued)

(52) U.S. Cl.
CPC ..... *A45D 40/267* (2013.01); *A45D 40/264* (2013.01); *A46B 9/005* (2013.01);
(Continued)

(58) Field of Classification Search
CPC .... A45D 40/264; A45D 40/267; A46B 9/005; A46B 9/021; A46B 2200/1056; A46B 2200/106; A46B 2200/1053
(Continued)

(56) References Cited

U.S. PATENT DOCUMENTS 1,059,282 A 4/1913 De Bassini
4,527,575 A * 7/1985 Vasas ..... A45D 40/26 132/218
(Continued)

FOREIGN PATENT DOCUMENTS

DE 828 902 C 1/1952
EP 1 129 641 A2 9/2001
(Continued)

OTHER PUBLICATIONS

U.S. Appl. No. 16/645,662, filed Mar. 9, 2020, Camille Schreiber.
(Continued)

*Primary Examiner* — Jennifer C Chiang
(74) *Attorney, Agent, or Firm* — Oblon, McClelland, Maier & Neustadt, L.L.P.

(57) ABSTRACT

The present invention relates to an applicator (10) of cosmetic product (P) for keratinous substances, particularly keratinous fibres, notably the eyelashes, the eyebrows, and/or the capillary fibres, comprising: —a core (40) that extends along a longitudinal axis (X), —at least one block (46) of porous material (47), —projecting elements (48) extending from the core (40) and at least partially passing through the porous material (47).

30 Claims, 3 Drawing Sheets

(51) Int. Cl.
*A46B 9/00* (2006.01)
*A46B 9/02* (2006.01)

(52) U.S. Cl.
CPC ..... *A46B 9/021* (2013.01); *A45D 2200/1018* (2013.01); *A46B 2200/106* (2013.01); *A46B 2200/1053* (2013.01)

(58) Field of Classification Search
USPC ..... 401/129
See application file for complete search history.

(56) References Cited

U.S. PATENT DOCUMENTS

| | | | | |
|---|---|---|---|---|
| 5,343,880 | A | 9/1994 | McKay | |
| 8,684,616 | B2 * | 4/2014 | Caulier | A46D 1/00 401/129 |
| 2001/0046406 | A1 | 11/2001 | Schrepf | |
| 2008/0105270 | A1 | 5/2008 | Walters et al. | |
| 2015/0250293 | A1 | 9/2015 | Hauger | |
| 2018/0295969 | A1 * | 10/2018 | Drugeon | A61K 8/30 |
| 2020/0352308 | A1 * | 11/2020 | Schreiber | A46B 15/00 |

FOREIGN PATENT DOCUMENTS

| | | | |
|---|---|---|---|
| JP | 3071310 | U | 8/2000 |
| JP | 2012-16374 | A | 1/2012 |
| KR | 20-0445344 | Y1 | 7/2009 |
| KR | 10-2011-0005302 | A | 1/2011 |
| WO | WO 2013/026853 | A1 | 2/2013 |

OTHER PUBLICATIONS

U.S. Appl. No. 16/645,638, filed Mar. 9, 2020, Camille Schreiber.
International Search Report dated Nov. 12, 2018 in PCT/EP2018/077384 filed Oct. 9, 2018.
Preliminary French Search Report dated Jun. 1, 2018 in French Patent Application No. 1759552 filed Oct. 12, 2017, (with English translation of Category of Cited Documents), 3 pages.
Notification of Reason for Refusal dated Jun. 29, 2021 in Korean Patent Application No. 10-2020-7009794 (with English machine translation), 15 pages.

* cited by examiner

APPLICATOR FOR APPLYING A COSMETIC PRODUCT TO KERATINOUS MATERIALS

FIELD OF THE INVENTION

The present invention relates to an applicator for applying a cosmetic product to keratinous materials, particularly keratinous fibres, notably to the eyelashes, eyebrows, and/or capillary fibres, and also to a packaging and application device comprising such an applicator and to a container containing the product to be applied.

DISADVANTAGES OF THE PRIOR ART AND OBJECTIVES OF THE INVENTION

Numerous mascara applicators which are injection moulded in plastic and commonly referred to as plastic brushes are known, these having projecting elements that are moulded with the core to bring a cosmetic product onto the eyelashes or eyebrows while at the same time combing or separating same.

Numerous mascara applicators comprising a brush having a core formed by two metal arms that are twisted together and grip fibres, are also known.

A mascara brush with a twisted core made up of one or more zones of mascara-absorbing material such as cotton fibres or a sponge made of a polymer material alternating, along the length of the brush, with one or more zones of substantially non-absorbent bristles or fibres, is known from EP 1 129 641.

A brush having, along the entire length of the brush, angular sectors formed of fibres alternating with angular sectors made of sponge, is also known, from KR 200445344.

Patent application US 2015/0250293 discloses a cosmetic product applicator comprising an applicator core and at least one elastic plate bearing fingers or fibres which has a three-dimensional shape before being assembled with the core.

U.S. Pat. No. 5,343,880 discloses a fluid dispensing wand having a fluid reservoir removably attachable to a wand for applying a fluid to the hair. Teeth and/or fins are formed upon the wand such that the wand may be moved through the hair in a comb-like fashion to effect transfer of the fluid thereto. An absorbent covering may optionally be formed over the wand intermediate the teeth or fins to further enhance the even distribution of fluid.

U.S. Pat. No. 1,059,282 relates to a fountain comb equipped with a strip of absorbent material calculated to retard the flow of liquid.

US 2008/0105270 is directed to hair styling tools having the ability to distribute a therapeutic agent into the hair via a porous material.

DE 828 902 discloses a comb having teeth and a reservoir of product and a sponge for applying the product near the teeth.

In the field of the invention, one objective is generally to provide applicators that allow the eyelashes, eyebrows and/or capillary fibres to be sufficiently loaded with product while at the same time combing them through effectively and gently. Now, when the length of the projecting elements or of the fibres is increased, these become more flexible and comfortable in application, and provide satisfactory combing. However, because the core of the applicator lies at a further distance from the free ends of the projecting elements or of the fibres, the amount of product loaded onto the eyelashes, eyebrows and/or capillary fibres is lower. If the length of the projecting elements or of the fibres is decreased, the amount of product loaded onto the eyelashes, eyebrows and/or capillary fibres is greater, but the projecting elements or the fibres are stiffer because of their shorter length, and this may prove to be unsatisfactory in terms of combing and in terms of the user's experience when applying make up and/or a cosmetic product for capillary fibres, such as a care product or colouring product.

There is a need to improve applicators for applying a cosmetic product to the eyelashes, the eyebrows and/or the capillary fibres, notably so as to enjoy applicators capable of satisfactorily making-up the eyelashes or the eyebrows by bringing a sufficient load of product onto, and correctly combing through, the eyelashes or eyebrows.

SUMMARY OF THE INVENTION

Applicator

The present invention seeks to meet this need and the subject of the invention, in one of the aspects thereof, is an applicator of cosmetic product for keratinous materials, particularly keratinous fibres, notably the eyelashes, the eyebrows and/or the capillary fibres, comprising:

- a core that extends along a longitudinal axis,
- at least one block of porous material,
- projecting elements extending from the core and at least partially passing through the porous material.

By virtue of the invention, it is possible to enjoy an applicator with a product reserve made up of the porous material and with projecting elements for combing through the eyelashes, eyebrows and/or capillary fibres.

In one particular embodiment, the core is at least partially made of a polymer material, notably by injection moulding. In this case, at least part of the projecting elements are advantageously made of a polymer material by injection moulding with the core, for example being in the form of teeth. The core may exhibit various shapes, particularly may form a rod, notably of small circular cross section, or a support, which is notably more extensive in at least one dimension.

As an alternative, the core comprises two arms, notably metal arms, twisted together, and at least part of the projecting elements forming fibres gripped between the arms.

The core is made from a material having a stiffness higher than that of the porous material. The longitudinal axis of the core may be rectilinear, curved or form at least one angle.

The projecting elements may be distributed uniformly or non-uniformly along the core.

The porous material may surround the core in cross section over at least an angular extent comprised between 45° and 360°, notably over an angular extent ranging from 90° to 360°. In instances in which the core forms a support, the porous material may at least partially cover one face of the core.

The applicator may comprise, in addition to the projecting elements extending from the core and at least partially passing through the porous material, additional projecting elements that do not pass through the porous material. These additional projecting elements are made from the same material as or from different materials from the said projecting elements. For example, the projecting elements and the additional projecting elements form fibres. In this case, the projecting elements may have a length shorter than that of the additional projecting elements. According to another example, the projecting elements and the additional projecting elements may form teeth produced by injection moulding in a polymer material, notably with the core. In this case, the projecting elements may be identical to the additional projecting elements. As an alternative, the additional projecting elements may have a length different from that of the projecting elements.

The height of the projecting elements, measured from the core, is preferably greater than or equal to the thickness, measured from the core, of the said at least one block of porous material. The thickness of the said at least one block of porous material, measured from the core, is for example comprised between 10% and 100%, notably 30% and 100%, for example between 50% and 100% of the height of the projecting elements measured from the core. In this case, the projecting elements may be formed by injection moulding of polymer, notably with the core, and for example form teeth. In such an embodiment, the porous material forms the reserve of product, constituting an increase in the reservoir of product on the applicator, while the projecting elements allow the product to be applied and the eyelashes or eyebrows to be combed.

The height of the projecting elements, measured from the core, may be comprised between 1 mm and 10 mm, better between approximately 2 mm and 6 mm. For example, the height of the projecting elements may be 10 mm in the case of a comb with projecting elements or spikes on one face.

The thickness measured from the core of said at least one block of porous material is for example comprised between 0.5 mm and 8 mm, better between approximately 1 mm and 5 mm.

The porous material is advantageously cellular. The cellular material may be selected from foams, notably polymer foams, such as polymer foams with open porosity, polymer foams with semi-open porosity, or polymer foams with closed porosity, sponges.

In the case of a polymer foam, the latter is, for example, selected from cross-linked polymer foams, particularly cross-linked thermoplastic polymer, notably cross-linked polyurethane, cross-linked polyether, cross-linked polyester or cross-linked polyethylene.

A polymer foam in general is to be understood as meaning a cellular material, or material with pockets, made from a polymer and made up of a three-dimensional structure formed by a solid skeleton comprising solid walls and/or solid edge corners, surrounding pockets or cells with spatially random orientations. The shape of the cells may be spherical or polyhedral.

In a polymer foam, the porosity, which is all of the voids created by the pores, or cells or pockets, exceeds 70% of the total volume of the foam.

What is meant by an "open porosity polymer foam" is the fact that the cells of this material are open to the adjacent cells and to the outside. In this case, it is only the edge corners surrounding the cells that form the solid skeleton of the foam. There are no solid walls.

In a "polymer foam with closed porosity", the cells are closed, being delimited from one another by walls. A "polymer foam with semi-open porosity" comprises walls at least some of which have at least one opening passing through them.

In the case of a cellular material formed by a polymer foam, the number of foam cells per unit length (PPI) that make up the cellular material is comprised between 10 and 80 PPI, better between 20 and 50 PPI, and better still approximately equal to 30 PPI. The number of cells per unit length, more commonly referred to as the PPI (Pores Per Inch), characterizes the polymer foam. It corresponds to the number of pores, or cells or pockets, intercepted in a length of 1 inch (2.54 cm).

In order to measure the number of cells per unit length as a PPI value, it is possible, as visible in FIG. 5, to use a ruler to visually measure the number of cells per unit length. 10 PPI thus corresponds to 10 cells per inch, namely to 10 cells per 2.54 cm. FIG. 5 illustrates six foams placed one after another, along the ruler, exhibiting different PPI values of 8, 10, 15, 20, 25 and 30 PPI respectively, with the PPI value increasing down the figure.

The density of the cellular material, notably of the polymer foam, is for example comprised between 15 kg/m$^3$ and 60 kg/m$^3$, better between 20 kg/m$^3$ and 40 kg/m$^3$, and better still equal to approximately 30 kg/m$^3$.

Such ranges of foam cells per unit length (PPI) and/or density parameters are particularly advantageous in the context of use of the applicator according to the invention for applying a cosmetic product such as a mascara composition or a colouration product and/or a care product for capillary fibres.

A mascara composition conventionally has a viscosity greater than 5 Pa·s, notably comprised between 5 Pa·s and 50 Pa·s, at 25° C., in particular measured with the aid of a Rheomat RM100® machine.

Such a mascara composition conventionally comprises a solids content, generally in an amount greater than or equal to 35% by weight relative to the total weight of the composition, a pulverulent colorant, in particular one or more pigments, notably one or more metal oxides, for example one or more iron oxides, and advantageously a film-forming polymer. A mascara composition may also conventionally comprise one or more waxes, in a total amount of in particular between 5 and 40% by weight relative to the total weight of the composition.

Thus, such ranges of foam cells per unit length (PPI) and/or density make it possible to obtain an applicator that demonstrates a good compromise between its abilities to retain and to release a cosmetic product having a viscosity comprised between 5 Pa·s and 50 Pa·s, notably comprised between 9 Pa·s and 25 Pa·s.

The product retention capacities of an applicator according to the invention in particular make it possible to prevent the cosmetic product held within the foam of the applicator from flowing under gravity through this applicator, thus improving the cleanliness and autonomy of such an applicator. The retention of cosmetic product within the foam of the applicator is in particular achieved by surface tension of the product held inside the cells present in the foam.

The product-release capacities of an applicator according to the invention in particular make it possible for the product held within the foam of the applicator to be loaded onto the eyelashes/eyebrows and/or the capillary fibres when these are brought into contact with the applicator. The release of the cosmetic product held within the foam of the applicator is achieved in particular by bringing the eyelashes, eyebrows and/or capillary fibres into contact with the cells of the foam, this contact breaking the surface tension that there is between the product and the cells of the foam, the product then being deposited on the eyelashes, eyebrows and/or capillary fibres.

The porous material may alternatively be chosen from among materials based on fibres, notably plant fibres such as cotton, flax, hemp, jute, bamboo, sisal, coconut fibre, modal, synthetic fibres such as polyester, polyurethane, viscose, polyamide fibres, or animal fibres, notably wool, horsehair, silk, and a mixture of these.

In instances in which the porous material is based on fibres, it may take the form of a woven, such as a mat or carpet, of a nonwoven, such as a felt, a wadding or a pad, a knit, notably a jersey, beaverteen, a piqué, a jacquard, a bouclé fabric, where applicable with a velours finish.

Moreover, and as explained hereinabove, the projecting elements of the applicator according to the invention extend out from the core and at least partially pass through the foam making it possible to comb, separate and/or lengthen the eyelashes, eyebrows and/or capillary fibres gently.

The block of porous material is advantageously attached to the core.

The way in which the block of porous material is attached to the core is for example selected from bonding, welding, notably ultrasonic welding, mechanical fastening, notably by crimping or by one or more retaining elements and/or a retaining stop, this list being nonlimiting. Several attachment methods may be used in combination. The projecting elements may constitute retaining elements.

In one particular embodiment, the porous material, notably when it is a foam, may be attached by means of a core having a distal portion onto which the block of porous material is slipped. The distal portion is connected to a proximal portion of the core by an articulation such as a film hinge. The distal portion is then folded back onto the proximal portion, complementary reliefs holding the distal portion on the proximal portion. The "back" or rear part of the distal portion is provided with the projecting elements.

The applicator may comprise a stem, the core being attached to the stem.

Packaging and Application Device

A further subject of the invention, in combination with the foregoing, is a device for packaging and applying a cosmetic product, notably to the eyelashes and/or the eyebrows and/or capillary fibres, comprising:

an applicator as defined above, a container containing the cosmetic product to be applied.

When the applicator comprises a stem, the core being attached to the stem, the stem of the applicator may be secured to a cap that closes the reservoir.

In that case, the container may comprise a wiping member for wiping at least the projecting elements and/or the porous material when the applicator is withdrawn from the container.

BRIEF DESCRIPTION OF THE FIGURES

The invention may be understood better from reading the following detailed description of nonlimiting exemplary embodiments thereof and from studying the appended drawing, in which.

DETAILED DESCRIPTION OF EMBODIMENTS

In the rest of the description, identical elements or elements having equivalent functions bear the same reference signs. Their description is not repeated for each of the figures, only the main differences between the embodiments being highlighted.

Figure 1:
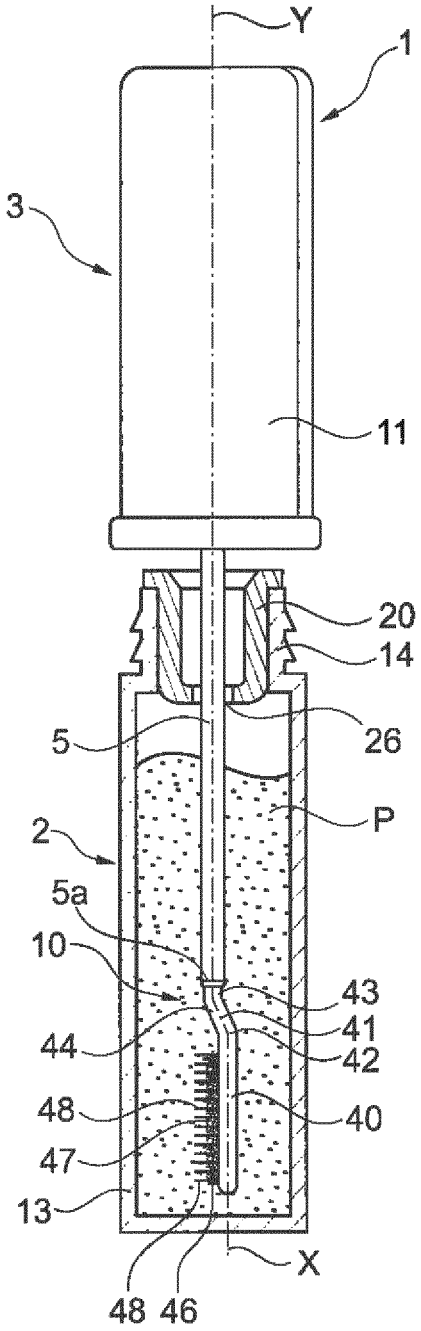
FIG. 1 depicts an example of a packaging and application device according to the invention, in schematic longitudinal section.

The packaging and application device 1 depicted in FIG. 1 comprises a container 2 containing a product P to be applied to the eyelashes or the eyebrows and an applicator system 3 which may, in the example in question, be attached removably to the container 2. The product P comprises, for example, one or more pigments, notably an iron oxide. It is preferably a mascara.

The applicator system 3 comprises, in this example, a stem 5 of longitudinal axis Y, which stem 5 is provided at a distal end 5*a* with an applicator 10 according to the invention and at the other end with a gripping member 11, which also forms a cap for closing the container 2 in a sealed manner. As can be seen notably in FIG. 1, said container comprises a body 13 provided at the top with a threaded neck 14 onto which the gripping member 11 can be screwed in order to close the container 2 in a sealed manner. As an alternative, the applicator system may be attached to the container in some other way.

As is shown, the neck 14 is able to receive a wiping member 20 which, for example, is attached therein. This wiping member 20 has a lip 26 defining a wiping orifice with a diameter suited to that of the stem 5.

The applicator 10 may be attached, in a conventional manner, in a housing provided at the distal end 5*a* of the stem 5, which stem is advantageously made of a thermoplastic material.

The applicator 10, in this example, comprises a core 40 extending along a longitudinal axis X. The proximal end part 41 of the core 40 is connected to the stem 5 and has an inflection 44 in the central part. Thus, this proximal end part 41 extends on one side 42 to the end of a rectilinear part of the core 40 and, on an opposite other side 43, is connected to the stem 5 parallel to the longitudinal axis Y. The longitudinal axis X forms two angles of inflection in the proximal end part 41.

The applicator 10 also comprises a block 46 of a porous material 47 and projecting elements 48 extending from the core 40 and at least partially, and in this example fully, passing through the porous material 47.

The core 40 in this example forms a support approximately 3 mm thick, and has a face 45 that receives the projecting elements 48. The core 40 has a face 52 opposite to the face 45, that is smooth, not provided with projecting elements. The core 40 is made of thermoplastic polymer by injection moulding with the projecting elements 48 formed of teeth. The projecting elements 48 are thus connected by their base to the face 45 of the core. The projecting elements 48 are uniformly arranged, in parallel rows, and are all identical to one another.

The block 46 of porous material 47 has a substantially rectangular parallelepipedal shape. The block 46 of porous material 47 is attached to the core 40, in this example by welding, particularly by ultrasonic welding. As an alternative or in addition, provision may be made for the block 46 of porous material 47 to be attached to the core 40 by bonding.

The height h of the projecting elements 48 measured from the core 40 is, in this example, approximately 3 mm thick, namely substantially equal to twice the thickness e of the block 46 of porous material 47 which in this example measures approximately 1.5 mm. The applicator 10 therefore comprises an application element 30 for the cosmetic product P, which is formed by the projecting elements 48 and the porous material 47.

Thus, by virtue of the invention, it is possible to have an applicator with projecting elements 48 which are relatively long, and therefore flexible, capable of gently and effectively combing through the eyelashes or eyebrows, while at the same time enjoying a product reserve formed by the porous material 47 a short distance away from the free end 51 of the projecting elements 48.

Figure 4:
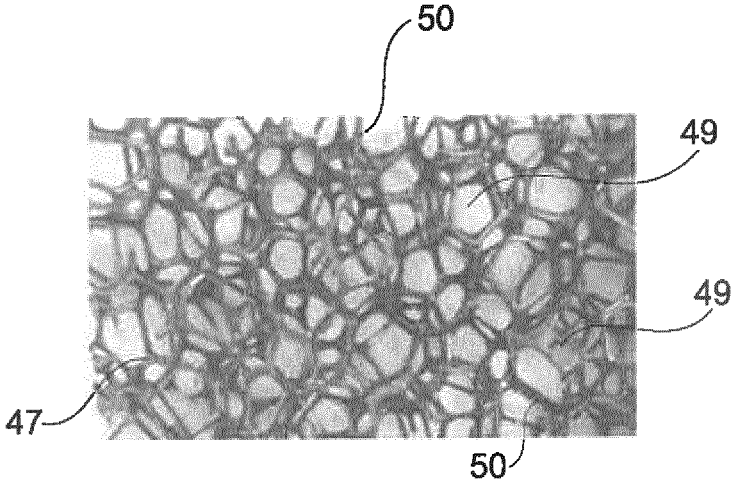
FIG. 4 is an enlarged view of one example of foam that can be used as porous material for the applicator according to the invention.
Figure 5:
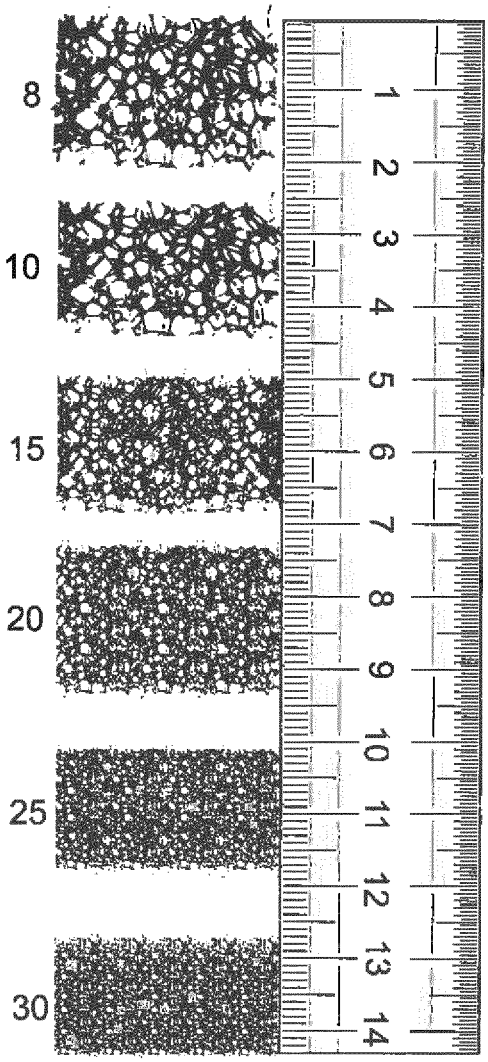
FIG. 5 is a schematic view illustrating several blocks of foams exhibiting different PPI values and the method for measuring these values, FIG. 6 schematically depicts, in a side view, another example of an applicator according to the invention, FIG. 7 schematically depicts, in a side view, another example of an applicator according to the invention, FIG. 8 schematically depicts, in a side view, another example of an applicator according to the invention.

FIG. 4 is an enlarged view of one example of foam that can be used as porous material 47. This porous material 47 in this instance is cellular, formed of a cross-linked polymer foam with open porosity, which means to say that forms polyhedral or spherical cells 49 constituting product reserves delimited from one another only by edge corners 50. It would not constitute a departure from the scope of the invention if the block 46 of porous material 47 were made of a foam with closed porosity or semi-open porosity, or from another porous material, such as fibrous materials formed for example of interlacings of cotton or of felt, amongst others.

Figure 2:
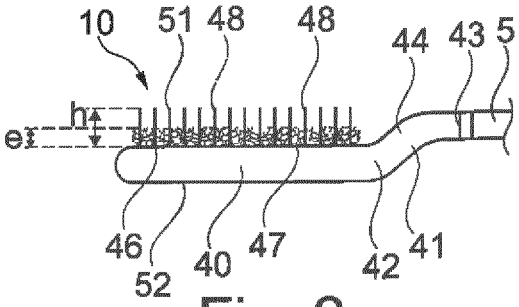
FIG. 2 is a schematic side view of the applicator of FIG. 1, viewed in isolation.
Figure 3:
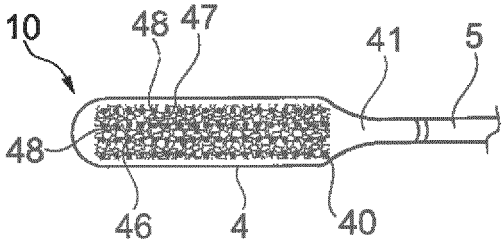
FIG. 3 is a view of the applicator of FIG. 2, from above.

In the example illustrated in FIGS. 1 to 3, the porous material 47 is a cellular material made of a cross-linked thermoplastic polymer foam with open porosity, notably cross-linked polyurethane (PUR). The density of the cellular material is approximately 30 kg/m$^3$ and the number of cells 49 per unit length is approximately 30 PPI.

By way of example, use may alternatively be made of a black-coloured polyester polyurethane foam with a density (in accordance with standard ISO 1855) of 29 kg/m$^3$ (+ or −3 kg/m$^3$). By way of example, the PPI value of such a material may be 20 PPI. In this case, the load-bearing capacity (in accordance with standard ISO 3386/1) is 3.7 kPa (+ or −1), the elongation at break (in accordance with standard ISO 1798) is greater than 120% and the tensile strength (in accordance with standard ISO 1798) is greater than 80 kPa. The PPI value may be 30 PPI. In this case, the load-bearing capacity (in accordance with standard ISO 3386/1) is 3.7 kPa (+ or −1), the elongation at break (in accordance with standard ISO 1798) is greater than 150% and the tensile strength (in accordance with standard ISO 1798) is greater than 95 kPa. The PPI value may even be equal to 45 PPI. In this case, the load-bearing capacity (in accordance with standard ISO 3386/1) is 3.8 kPa (+ or −1), the elongation at break (in accordance with standard ISO 1798) is greater than 180% and the tensile strength (in accordance with standard ISO 1798) is greater than 100 kPa. The PPI value may even be equal to 60 PPI. In this case, the load-bearing capacity (in accordance with standard ISO 3386/1) is 4.2 kPa (+ or −1), the elongation at break (in accordance with standard ISO 1798) is greater than 200% and the tensile strength (in accordance with standard ISO 1798) is greater than 140 kPa. The PPI value may also be 80 PPI. In this case, the load-bearing capacity (in accordance with standard ISO 3386/1) is 4.2 kPa (+ or −1), the elongation at break (in accordance with standard ISO 1798) is greater than 230% and the tensile strength (in accordance with standard ISO 1798) is greater than 170 kPa. Of course, intermediate PPI values are possible.

Figure 6:
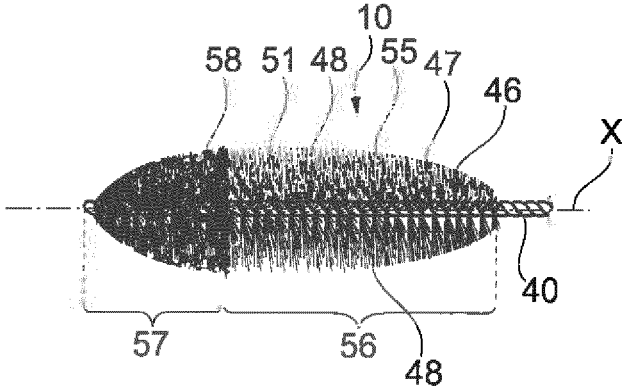

FIG. 6 depicts another example of an applicator 10 according to the invention, comprising a core 40 formed of two metal arms twisted together entrapping projecting elements 48 formed of fibres 55. The core 40 therefore forms a rod completely surrounded in cross section by projecting elements 48 in a proximal first zone 56. A distal second zone 57, positioned next to the proximal first zone 56, also comprises additional projecting elements 58 likewise formed of fibres trapped between the twisted metal arms of the core 40. In the proximal first zone 56, the applicator 10 comprises the block 46 of porous material 47 completely surrounding the core in cross section and having a thickness substantially equal to the height of the fibres 55. The application element 30 of the applicator 10 in this example is formed by the projecting elements 48, the porous material 47 and the additional projecting elements 58. The shape of the application element 30 in this example is ovoid. In this example too, the longitudinal axis X of the core 40 is rectilinear.

The exterior surface 60 of the application element 30 may have various shapes. The exterior surface may, for example, exhibit an overall shape selected from the group consisting of a cylindrical shape, an ogive shape, an ovoid shape, a rugby-ball shape, a frustoconical shape, a conical shape, a biconical shape, a peanut shape, a diabolo shape, a shape exhibiting axial symmetry, a shape with no axial symmetry, a shape with reliefs, notably notches, grooves, ribs, slots, and any combination of these shapes.

Figure 7:
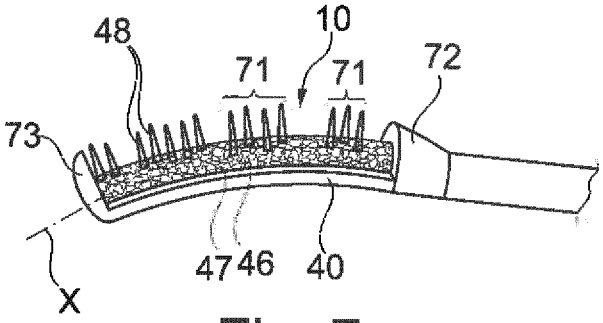

The applicator 10 depicted in FIG. 7 illustrates the possibility of the longitudinal axis X being curved. Moreover, in this example with a core 40 produced by injection moulding of thermoplastic polymer, the projecting elements 48 are arranged in groups 71 rather than being equidistant from one another. The core 40 forms end stops 72 and 73 at the proximal and distal ends respectively.

The applicator in FIG. 7, like the one in FIGS. 1 to 3, may be classified as comb.

Figure 8:
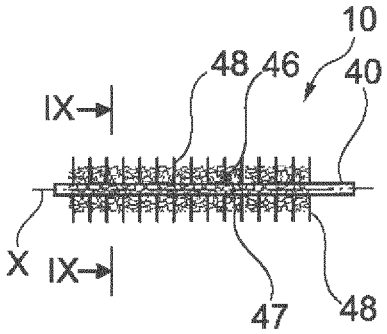
Figure 9:
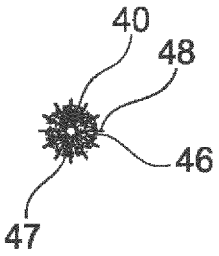
FIG. 9 is view in cross section on IX of FIG. 8.

In the example of FIGS. 8 and 9, the core 40 is likewise produced by injection moulding of thermoplastic polymer with the projecting elements 48, but in the form of a circular brush, the projecting elements 48 completely surrounding the core 40 in cross section, as can be seen in FIG. 9. The block 46 of porous material 47 also completely surrounds the core 40 in cross section.

Figure 10:
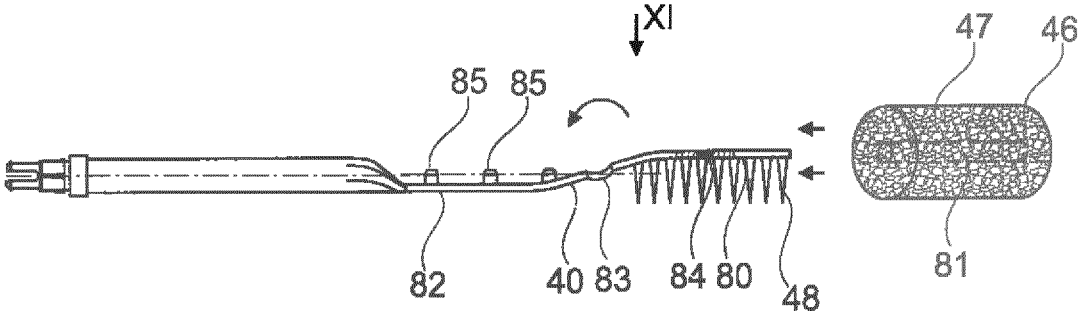
FIG. 10 is a schematic side view of another example of an applicator according to the invention prior to the attachment of the block of porous material to the rest of the applicator.
Figure 11:
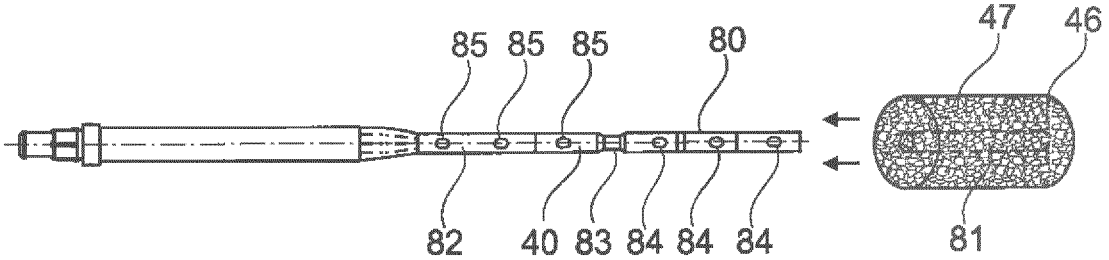
FIG. 11 is a schematic view from above, in the direction of arrow XI of the example of FIG. 10.
Figure 12:
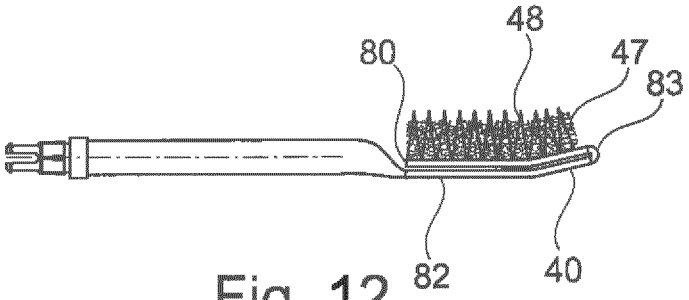
FIG. 12 is a schematic side view of the applicator of FIGS. 10 and 11 after the block of porous material has been attached to the rest of the applicator, and the applicator finalized.

In the embodiment of FIGS. 10 to 12, the block 46 of porous material 47, notably when this is a foam, is attached by means of a core 40 that has a distal portion 80. The block 46 of porous material 47 is slipped, as illustrated by the two parallel arrows, onto this distal portion 80 via a longitudinal through-opening 81 which is substantially central in the block 46 in this embodiment, or directly through the block 46 of porous material 47. The distal portion 80 is connected to a proximal portion 82 of the core 40 by an articulation 83, in this example a film hinge. The distal portion 80 is then folded back onto the proximal portion 82, as illustrated by the curved arrow, complementary reliefs 84 and 85 present respectively on the distal portion 80 and on the proximal portion 82 holding the distal portion 80 on the proximal portion 82. In the example illustrated, the reliefs 84 present on the distal portion 80 are orifices, three of them, which complement projecting reliefs 85 of the proximal portion 82. The reliefs 85 at their free end have a bead allowing them to be fixed in the orifices in such a way as to secure the distal portion 80 to the proximal portion 82, trapping part of the block 46 of porous material 47, as illustrated in FIG. 12. The rear or back of the distal portion 80 is provided with the projecting elements 48 which project out of the block 46 of porous material, notably of foam.

The invention claimed is:

1. Applicator of cosmetic product for keratinous substances, comprising:

a core that extends along a longitudinal axis, at least one block of cellular porous material, and projecting elements extending from the core and at least partially passing through the cellular porous material by penetrating the cells of the cellular porous material.

2. The applicator according to claim 1, wherein the core is at least partially made of a polymer material by injection moulding.

3. The applicator according to claim 2, in which at least part of the projecting elements is produced in polymer material.

4. The applicator according to claim 1, in which the core comprises two arms twisted together, and at least part of the projecting elements forming fibres gripped between the arms.

5. The applicator according to claim 1, wherein the porous material surrounds the core in cross section over at least an angular extent comprised between 45° and 360°.

6. The applicator according to claim 1, wherein the core forms a support, the porous material at least partially covering one face of the core.

7. The applicator according to claim 1, further comprising additional projecting elements that do not pass through the porous material.

8. The applicator according to claim 1, wherein the height (h) of the projecting elements, measured from the core, is greater than or equal to the thickness, measured from the core, of the said at least one block of porous material.

9. The applicator according to claim 1, wherein the height of the projecting elements, measured from the core, is between 1 mm and 10 mm.

10. The applicator according to claim 1, wherein the thickness measured from the core of the said at least one block of porous material is between 0.5 mm and 8 mm.

11. The applicator according to claim 1, wherein the porous material is selected from polymer foams with open porosity or with semi-open porosity, or polymer foams with closed porosity.

12. The applicator according to claim 11, wherein the polymer foam is selected from cross-linked polymer foams, cross-linked polyether, cross-linked polyester or cross-linked polyethylene.

13. The applicator according to claim 12, wherein the number of foam cells per unit length (PPI) that make up the porous material is between 10 and 80 PPI.

14. The applicator according to claim 1, wherein the density of the porous material is between 15 kg/m$^3$ and 60 kg/m$^3$.

15. The applicator according to claim 1, wherein the block of porous material is attached to the core.

16. The applicator according to claim 15, wherein the way in which the block of porous material is attached to the core is selected from bonding, welding, overmoulding and mechanical fastening.

17. The applicator according to claim 1, wherein the porous material is attached by a core having a distal portion onto which the block of porous material is slipped, the distal portion being connected to a proximal portion of the core by an articulation, the distal portion then being folded back onto the proximal portion, complementary reliefs holding the distal portion on the proximal portion, the rear part of the distal portion being provided with the projecting elements.

18. The applicator according to claim 1, further comprising a stem, the core being attached to the stem.

19. A device for packaging and applying a cosmetic product to the eyelashes and/or eyebrows and/or capillary fibres, comprising:

an applicator according to claim 1, and a container containing the cosmetic product to be applied.

20. The device according to claim 19, the applicator comprising a stem, the core being attached to the stem, the stem of the applicator being secured to a cap that closes the container.

21. The device according to claim 20, wherein the container comprises a wiping member for wiping at least the projecting elements and/or the porous material when the applicator is withdrawn from the container.

22. The applicator according to claim 3, wherein at least part of the projecting elements is produced in polymer material by injection moulding with the core.

23. The applicator according to claim 9, wherein the height of the projecting elements, measured from the core, is between 2 mm and 6 mm.

24. The applicator according claim 1, wherein the thickness (e) measured from the core of the said at least one block of porous material is between 1 mm and 5 mm.

25. The applicator according to claim 1, wherein the number of foam cells per unit length (PPI) that make up the porous material is between 20 and 50 PPI.

26. The applicator according to claim 1, wherein the number of foam cells per unit length (PPI) that make up the porous material is approximately equal to 30 PPI.

27. The applicator according to claim 1, wherein the density of the porous material is between 20 kg/m$^3$ and 40 kg/m$^3$.

28. The applicator according to claim 1, wherein the density of the porous material is equal to approximately 30 kg/m$^3$.

29. An applicator of cosmetic product for keratinous substances, particularly keratinous fibres, notably the eyelashes, the eyebrows, and/or the capillary fibres, comprising:

a core that extends along a longitudinal axis, at least one block of porous material, projecting elements extending from the core and at least partially passing through the porous material, in which the porous material is attached by means of a core having a distal portion onto which the block of porous material is slipped, the distal portion being connected to a proximal portion of the core by an articulation, the distal portion then being folded back onto the proximal portion, complementary reliefs holding the distal portion on the proximal portion, the rear part of the distal portion being provided with the projecting elements.

30. The applicator according to claim 29, in which the articulation is a film hinge.

* * * * *